US005421261A

United States Patent [19]

Stempien

[11] Patent Number: 5,421,261

[45] Date of Patent: Jun. 6, 1995

[54] PRINTING APPARATUS HAVING WEB-CLEANING MEMBERS FOR REMOVING PARTICLES AFFECTING PRINT QUALITY

[75] Inventor: Joseph W. Stempien, Newington, Conn.

[73] Assignee: Gerber Scientific Products, Inc., Manchester, Conn.

[21] Appl. No.: 54,072

[22] Filed: Apr. 27, 1993

[51] Int. Cl.[6] ..... B41F 35/00

[52] U.S. Cl. ..... 101/423; 101/425

[58] Field of Search ..... 101/423, 425, 424, 167, 101/168; 15/256.5, 256.53, 256.6, 100, 102; 355/302, 299–301, 270, 283, 296, 297

[56] References Cited

U.S. PATENT DOCUMENTS

| | | | |
|---|---|---|---|
| 3,914,817 | 10/1975 | Lindsay | 15/100 |
| 4,389,936 | 6/1983 | Jaffa et al. | 101/425 |
| 4,467,525 | 8/1984 | Logan et al. | 33/18 B |
| 4,512,839 | 4/1985 | Gerber | 156/248 |
| 4,527,887 | 7/1985 | Vineski | 355/299 |
| 4,618,870 | 10/1986 | Inoue | 346/76 PH |
| 4,787,500 | 11/1988 | Holz | 15/256.5 |
| 4,799,172 | 1/1989 | Wood et al. | 364/518 |
| 4,804,975 | 2/1989 | Yip | 346/76 L |
| 4,834,276 | 5/1989 | Logan | 226/76 |
| 5,110,228 | 5/1992 | Yokomizo | 400/208 |

FOREIGN PATENT DOCUMENTS

| | | | |
|---|---|---|---|
| 0501151 | 9/1992 | European Pat. Off. | 355/301 |
| 8709302 | 10/1987 | Germany . | |
| 0078582 | 5/1982 | Japan | 355/302 |
| 59-7983 | 1/1984 | Japan . | |
| 59-57771 | 4/1984 | Japan . | |
| 0199279 | 11/1984 | Japan | 101/425 |
| 0167871 | 7/1989 | Japan | 355/299 |
| 0185670 | 7/1989 | Japan | 355/270 |
| 1-286879 | 11/1989 | Japan . | |
| 0211487 | 8/1990 | Japan | 355/301 |

OTHER PUBLICATIONS

Charles A. Whited "Brush For Charging, Detack, Cleaning And/Or Tranfer" Xerox Disclosure Journal, vol. 8, No. 1, Jan./Feb. 1983.

*Primary Examiner*—Edgar S. Burr
*Assistant Examiner*—Anthony H. Nguyen
*Attorney, Agent, or Firm*—McCormick, Paulding & Huber

[57] ABSTRACT

An apparatus for printing images on sheet material has a housing, a roller platen mounted within the housing for supporting the sheet material, and a print head mounted adjacent to the platen for receiving the sheet material between the platen and the print head and printing images onto the sheet material passed between the platen and the print head. Two first wiper-blade assemblies are mounted on either side of the roller platen relative to each other, and each wiper-blade assembly has at least one wiper blade extending across the width of the :sheet material defining an edge portion contacting the sheet material, for continuously removing dust particles and other debris from the sheet material prior to passage between the print head and the roller platen. A donor web bearing printing ink is interposed between the print head and the sheet material for forming graphic images on the sheet material by transfer of ink from the donor web to the sheet material. Two second wiper-blade assemblies are mounted on opposite sides of the print head relative to each other, and each second wiper-blade assembly includes a wiper blade defining an edge portion contacting the surface of the donor web facing the print head, for removing dust particles and other debris from the surface of the donor web prior to passage between the print head and the roller platen.

19 Claims, 4 Drawing Sheets

PRINTING APPARATUS HAVING WEB-CLEANING MEMBERS FOR REMOVING PARTICLES AFFECTING PRINT QUALITY

FIELD OF THE INVENTION

The present invention relates to printing apparatus for making graphic product on sheet material, and more particularly, to apparatus for continuously cleaning printed sheets, or webs bearing printing ink to enhance the quality of the graphic products produced by the printing apparatus.

BACKGROUND INFORMATION

There are numerous types of equipment and processes available for printing signs or other products with graphic designs, characters or other graphic images. Typically, a sheet or web of the material upon which the graphic images are printed (the "print sheet") is passed between a platen and a printing head, and the graphic images are transferred or formed on the print sheet by the printing head. In some devices, the print sheet is thermally-sensitive, and the printing head includes heating elements that are selectively activated to form graphic images on the thermally-sensitive sheet. In other devices, a donor web or foil bearing printing ink is passed between the printing head and the print sheet. The printing head typically includes heating elements which are selectively activated to transfer ink from the donor web onto the print sheet to form graphic images.

With the development of computer-aided-design (CAD) systems, in the fields of printing and signmaking, for example, single or multi-colored images can be created and stored in a data base and transferred onto a print sheet to produce customized signs or other printed matter. In the signmaking field, graphic images are printed onto print sheets made of vinyl or other plastics secured by a pressure-sensitive adhesive on a releasable backing material. Once the graphic images are transferred to, or formed on a vinyl print sheet, the print sheet is cut, typically with an automatic cutter, along the outline(s) of the graphic images, and the cut pieces are then attached to a sign board by means of the pressure-sensitive adhesive after removal of the releasable backing material. Sophisticated multi-colored and/or enhanced graphic images, including two-dimensional images that appear three-dimensional, can be readily created and transferred onto a print sheet to form such customized signs or other printed matter with relative ease and rapidity.

The collection of dust particles or other debris on the print sheet can significantly degrade the print quality of the graphic images, particularly in more sophisticated systems, which print graphic images with a relatively fine degree of resolution. Dust particles or other minute debris can cause fuzziness, blurring or other aberrations within the printed graphic images which can noticeably degrade the print quality of even the most sophisticated printing or signmaking systems. In systems employing sheet material with punched holes along the edges of the sheet for feeding the sheets through the printing apparatus, loose particles or fibers of the sheet material frequently remain in and around the punched holes from the hole-punching operation. This minute debris also tends to drift or collect on the printing surface of the sheet material, and in turn degrades the print quality of the printing apparatus.

In printing apparatus employing thermal-activated printing heads, such as the type described above in which the donor web or foil bearing printing ink is passed between the printing head and the print sheet, dust particles or other minute debris can also collect on the donor web and affect the thermal-transfer properties of the web. This too can cause fuzziness, blurring or other aberrations within the printed graphic images which can noticeably degrade print quality.

Static electricity can increase the quantity of dust particles or other debris collected within printing apparatus. Static charges on the print sheet or on the donor web cause additional dust particles to collect on the print sheet or donor web, respectively, and further degrade the print quality of the system.

It is an object of the present invention to overcome the drawbacks and disadvantages of prior printing apparatus due to the collection of dust particles or liquids, or other debris in the apparatus and on the print sheets or donor webs in such apparatus.

SUMMARY OF THE INVENTION

The present invention is directed to an apparatus for printing images on sheet material having web-cleaning members for removing particles affecting print quality. In one embodiment of the present invention, the apparatus comprises a housing, a platen mounted within the housing for supporting the sheet material, and a print head mounted adjacent to the platen for receiving the sheet material between the platen and print head, and printing images onto the sheet material passed between the platen and the print head. The apparatus also includes at least one first wiper blade mounted within the housing and defining at least one edge portion oriented relative to the sheet material to contact the surface of the sheet material facing the print head, and which extends across the sheet material a distance approximately equal to the distance within which the print head prints images on the sheet material. The first wiper blade continuously wipes the sheet material during printing operations to remove dust particles and other debris from the sheet material and enhance the print quality of the apparatus.

In one embodiment of the present invention, the apparatus comprises two first wiper blades mounted on opposite sides of the platen relative to each other. Preferably, the apparatus further comprises at least one second wiper blade mounted between each first wiper blade and the sheet material. Each second wiper blade defines at least one edge portion oriented relative to the sheet material for contacting the sheet material, which extends across the sheet material a distance approximately equal to at least the distance within which the print head prints images on the sheet material. Each second wiper blade continuously wipes the sheet material during printing operations to remove dust particles and other minute debris from the sheet material not removed by the adjacent first wiper blade.

In one embodiment of the present invention, the apparatus further comprises a donor web bearing ink interposed between the print head and the platen to form images on the sheet material by transfer of ink from the donor web to the sheet material. At least one third wiper blade is mounted within the housing and defines at least one edge portion suspended in contact with the donor web, which extends across the web a distance equal to at least approximately the width of the web. The third wiper blade continuously wipes the donor web to remove dust particles and other minute debris and enhance the print quality of the apparatus. Preferably, the apparatus comprises two third wiper blades mounted on opposite sides of the print head relative to each other.

In one embodiment of the present invention, the edge portion of each wiper blade which is in contact with either the sheet material or the donor web, is made from either a conductive or static dissipative material to conduct or bleed any static electricity away from the sheet material or web and further reduce the quantity of dust particles or other debris that might otherwise collect on the sheet material or donor web.

One advantage of the apparatus of the present invention, is that the wiper blades continuously wipe the surface of the sheet material upon which the graphic images are printed during printing operations, and/or continuously wipe the donor web bearing printing ink during printing operations to remove substantially all dust particles or other minute debris from the respective surfaces of the sheet material and/or the donor web prior to passage between the platen and the print head. Because the dust particles and other minute debris are removed from these surfaces, the fuzziness, blurring or other aberrations normally associated with prior printing apparatus due to the collection of dust particles or other minute debris on the sheet material or donor web is substantially eliminated, and the print quality of the apparatus of the present invention is significantly enhanced.

Another advantage of the apparatus of the present invention, is that when the edge portion of each wiper blade in contact with the sheet material and/or donor web is made from a conductive or static dissipative material, static electricity on the surfaces of the sheet material and/or donor web is permitted to bleed away from these surfaces, and thus the quantity of dust particles and other minute debris normally collected on these surfaces due to static electricity is significantly reduced.

Other advantages of the present invention will become apparent in view of the following detailed description and accompanying drawings.

DETAILED DESCRIPTION

Figure 1:
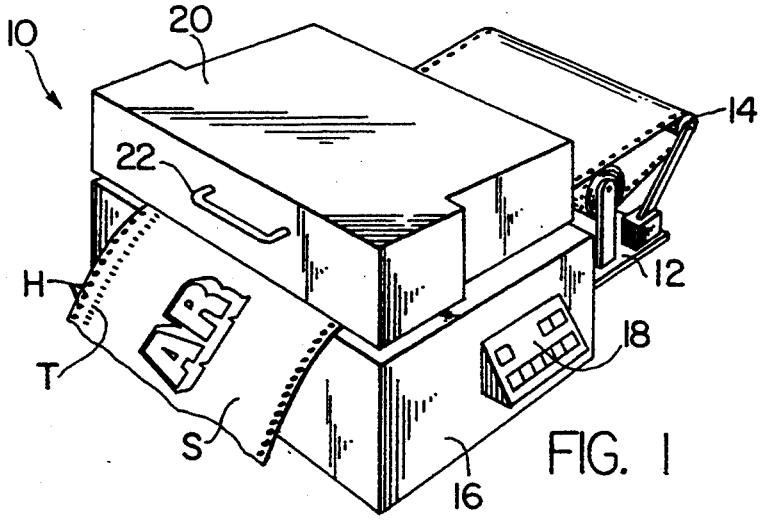
FIG. 1 is a perspective view illustrating one embodiment of a thermal printer comprising web-cleaning members embodying the present invention.

In FIG. 1, an apparatus embodying the present invention for printing signs, characters, designs and other graphic products is indicated generally by the reference numeral 10. The printing apparatus 10 can be employed within a microprocessor-based system in which graphic product is created and produced with enhancements from a data base on which both the printed and cut features of the product are commonly based. One such system is disclosed in co-pending patent application Ser. No. 08/007,662, filed Jan. 22, 1993, entitled "Method And Apparatus For Making A Graphic Product", assigned to the same Assignee as is the present invention, and which is hereby incorporated by reference as part of the present disclosure. It is noted, however, that although apparatus embodying the present invention may be employed in such microprocessor-based systems, they may equally be employed in other types of systems for printing signs and other graphic products, as will be evident to those of ordinary skill in the art based upon the disclosure of the present specification.

The printer 10 utilizes a set of sprockets to engage corresponding feed or drive holes H spaced along each edge of a strip S forming a print sheet or web from which graphic product is prepared. A cutter (not shown) has a set of sprockets to engage the same series of feed holes H during a cutting operation in which the cutter cuts the sheet S along the peripheral edges of the image or images and any internal edges in accordance with a cutting program. The sheet S may be a vinyl secured by a pressure-sensitive adhesive on a releasable backing. One such vinyl print sheet is sold by the Assignee of the present invention under the trademark SCOTCHCAL of 3M Company. After weeding to remove unwanted material within or around the graphic image or images, the vinyl upon which the enhanced graphic image or images is formed is lifted from the underlying backing material and attached to a sign board, window or other suitable object.

As an alternative to the feed holes H, the printer 10 can prepare a positional reference track T on the print-receiving surface of the print sheet S to establish a known positional relationship between the printed image on the strip S and the strip itself. The cutting operation is then carried out by the cutter after the printing operation, and the cutter reads the positional reference track on the sheet material in order to coordinate the position of the material and the cutting tool with the printed material.

As shown in FIG. 1, the strip S is supplied in a roll which is supported on a platform 12 located on the back side of the printer and is fed over a guide roller 14 before it enters a housing 16 of the printer. After the strip S is passed through the printer 10 where the printing operation takes place, it is discharged freely through the front side of the machine or may be retrieved on a take-up roll (not shown) if desired. The printer 10 is preferably coupled to a separate controller (not shown) for controlling the printing operation, but the printer also includes a control panel 18 on the housing 16 to start and stop printing operations. The control panel 18 includes controls for slewing the strip S independently of the printing operation and other controls for operating the printer. A cover 20 is pivotally mounted on top of the housing 16 and can be opened and closed by gripping a handle 22 to access the internal structure of the printer, as shown in FIGS. 2 and 3.

Figure 2:
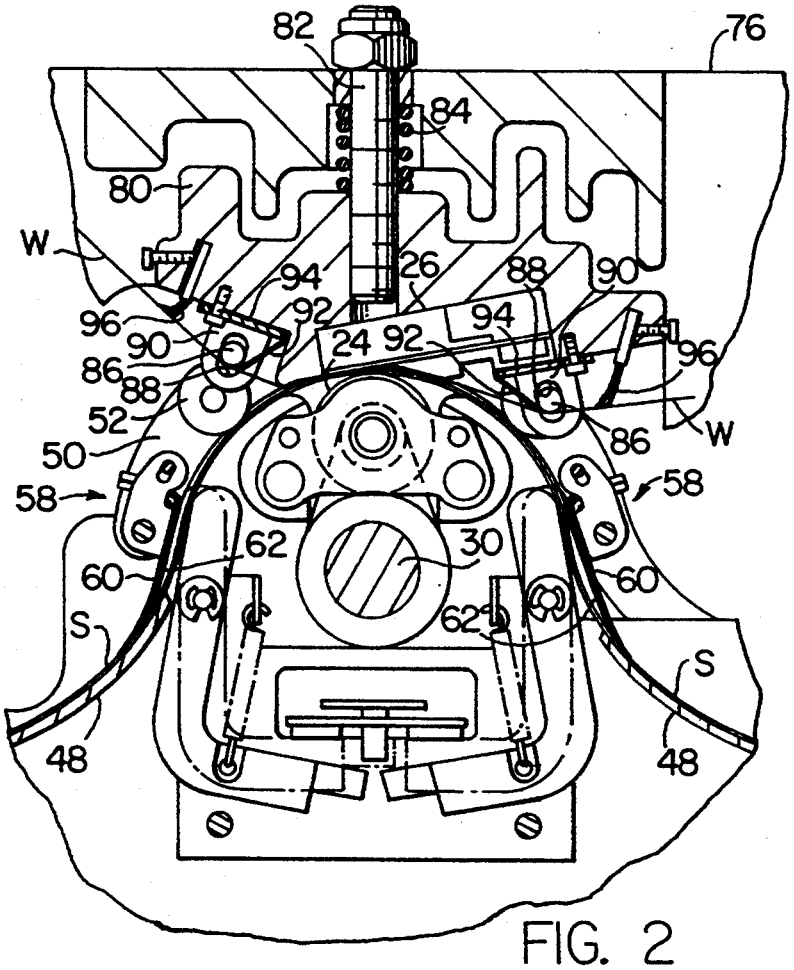
FIG. 2 is an enlarged fragmentary view of the printer of FIG. 1 illustrating the print head, roller platen, and web-cleaning members of the present invention.

Turning to FIG. 2, within the printer 10, the strip S passes over a roller platen 24 relative to a thermal print head 26 which is pressed downward onto the strip S and generally establishes a linear zone of contact between the strip and the platen. The outer surface of the platen 24 is defined by a hard rubber sleeve, and a marginal portion of the strip S defining a respective series of spaced feed holes H overlaps the rubber sleeve of the platen at each end. A drive sprocket 28 defines a set of sprocket pins which engage a respective series of feed holes H along one marginal edge of the strip S, and a similar drive sprocket 28 defines sprocket pins which engage the other series of feed holes H along the opposite marginal edge of the strip.

Figure 3:
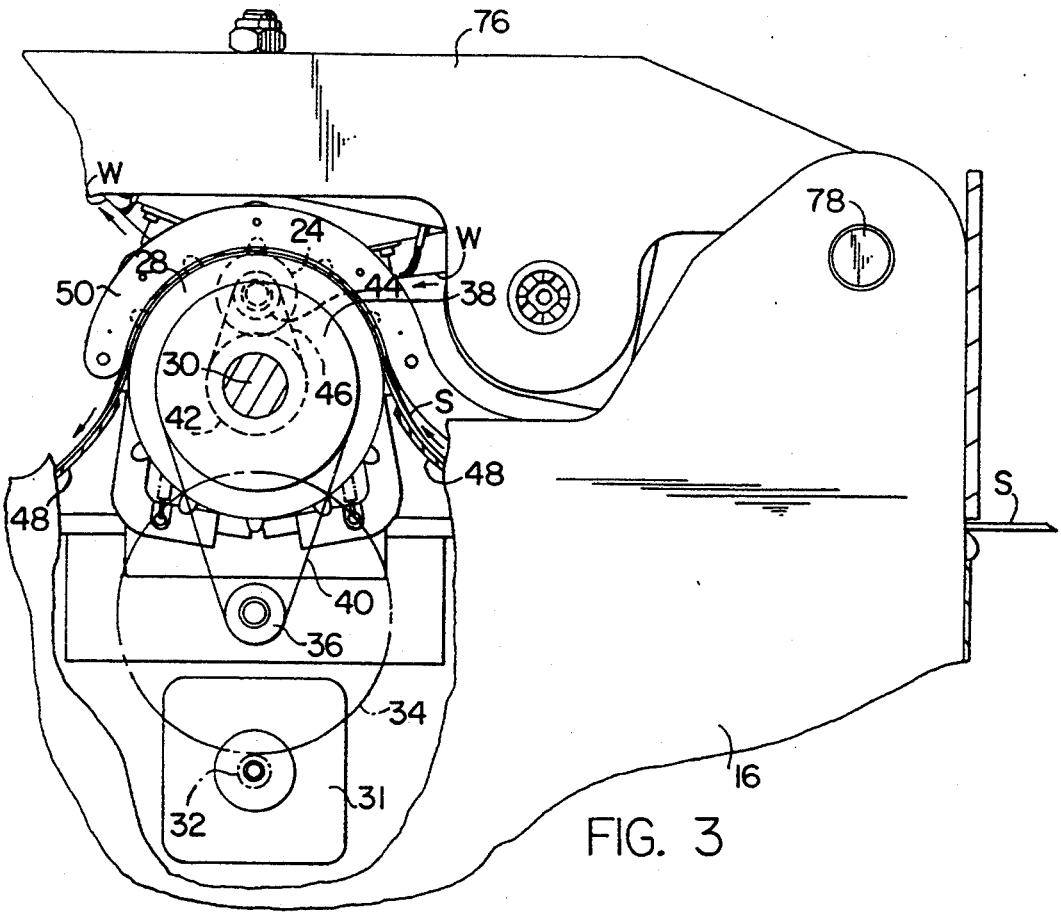
FIG. 3 is an enlarged fragmentary view of the printer which is similar to FIG. 2, illustrating the drive mechanism for moving a strip of sheet material relative to the print head, and the manner in which the web-cleaning members remove dust particles and other minute debris from the sheet material and donor web bearing printing ink.

As shown in FIG. 3, each drive sprocket 28 is fixedly mounted to one end of a drive shaft 30. The drive shaft 30 is rotatably mounted within the housing 16 and is driven from a step motor 31 by a series of drive gears 32,34, toothed drive pulleys 36,38, and a toothed drive belt 40. The roller platen 24 is rotatably mounted within the housing 16 and is driven from the drive shaft 30 by means of a pair of drive pulleys 42,44 and a respective O-ring drive belt 46 mounted on each end of the platen. The drive pulleys 42,44 are selected to establish a peripheral speed of the roller platen 24 slightly higher than the peripheral speed of the drive sprockets 28 to augment the feeding of the strip S past the print head 26. Since the drive sprockets 28 positively engage the strip and control the speed of the strip, the O-ring drive belts 46 allow limited slip. As shown in FIG. 2, a paint of curved, sheet metal plates 48 guide the strip S circumaxially onto and off of the roller platen 24 and the cylindrical surfaces of the sprockets 28 in a U-shaped feed path.

Figure 4:
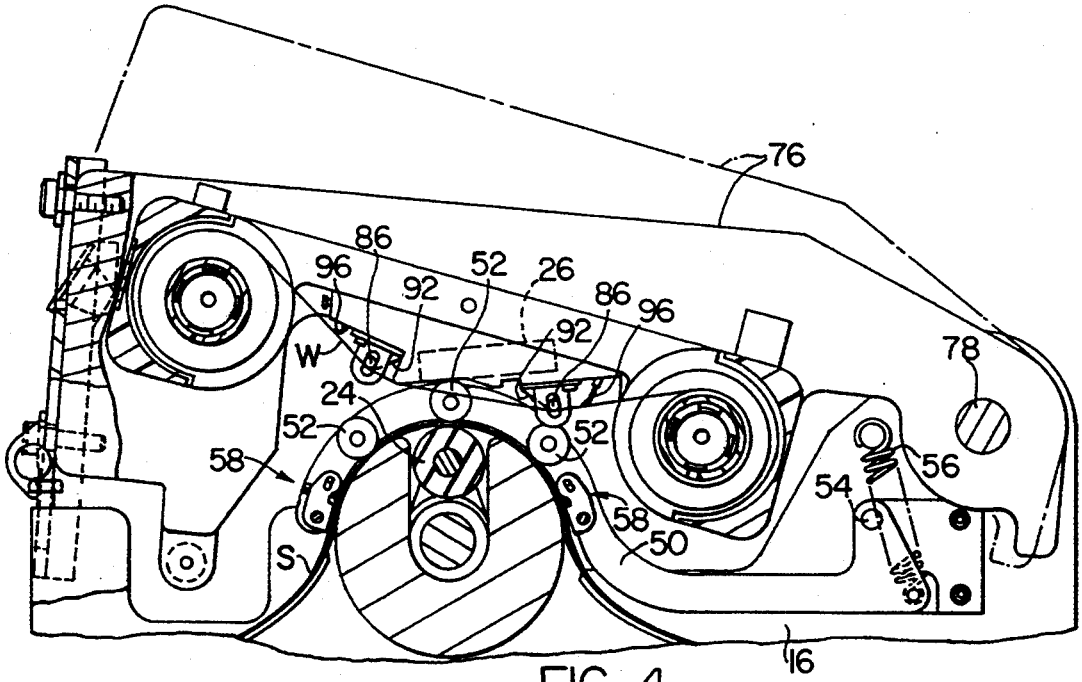
FIG. 4 is a side elevation view of the printer of FIG. 1 illustrating the cassette supporting the donor web with the printing ink, the mounting structure for the bails for holding down the sheet material against the roller platen, and the mounting structure of the frame member supporting the print head.

To keep the strip S fully engaged with approximately 180° of the sprockets 28, a pair of holddown bails 50 each defines a generally C-shaped section which straddles the pins of a respective sprocket. As shown in FIG. 4, the C-shaped section of each holddown bail 50 includes three bail wheels 52, which are each rotatably mounted and spaced apart from each other along the respective C-shaped section, to maintain the respective marginal edge of the strip S in firm engagement with the cylindrical surface of the respective sprocket 28. The bails are pivotally suspended from the housing 46 on pins 54, so that the bails can be lifted away from the sprockets 28 and allow a strip S of sheet material to be mounted on and removed from the sprockets and roller platen 24. Over-center springs 56 assist in holding the bails downward on the strip S, while permitting the bails to be lifted away from the sprockets during installation or removal of a strip.

Figure 5:
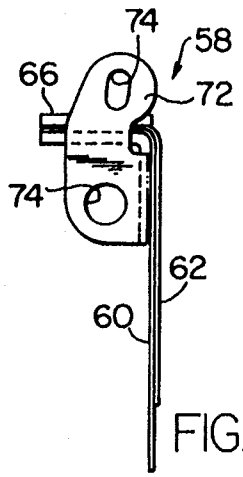
FIG. 5 is an end plan view of the web-cleaning assembly illustrated in FIGS. 2–4 for removing dust particles and other debris from the surface of the sheet material.
Figure 6:
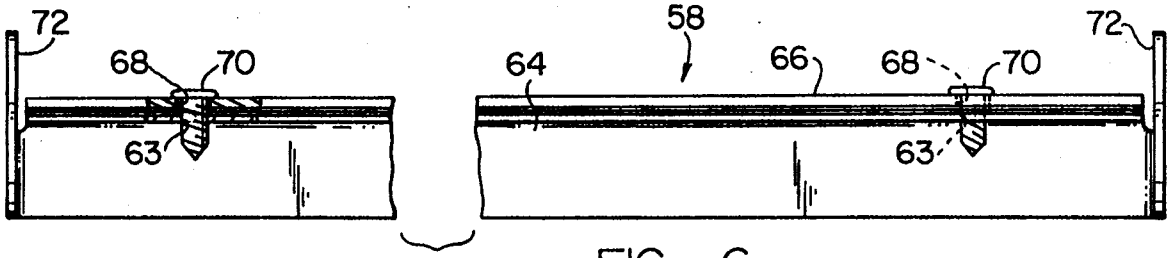
FIG. 6 is a front plan view of the web-cleaning assembly of FIG. 5.

A pair of web-cleaning or wiper-blade assemblies 58 extend between the bails 50 and are located at the supply and discharge points of the roller platen 24. As shown in FIGS. 5 and 6, each wiper-blade assembly includes a first web-cleaning member or blade 60 and a second web-cleaning member or blade 62, each of which extends between the bails 50 and is maintained in engagement with the surface of the strip S along an edge portion. The other side of each blade 60 and 62 is coupled to a wiper frame 64, which is mounted on each end to a respective bail 50. Each wiper frame 64 defines a generally L-shaped cross section, wherein one leg of the L defines a plurality of apertures 63 spaced apart from each other and extending through the respective leg. The first blade 60 and the second blade 62 define corresponding apertures and are each clamped along an edge portion between the wiper frame 64 and a clamping bar 66. Each clamping bar 66 defines a plurality of apertures 68 extending through the clamping bar and aligned with the apertures 63 for receiving fasteners 70 to fixedly mount the first and second wiper blades 60 and 62, respectively, to the wiper frame 64. The end of each wiper frame 64 includes a side wall 72, which defines a pair of mounting apertures 74 for receiving fasteners to Alternately, the wiper blades can be secured to the frame with double-faced tape.

As shown in FIG. 2, each wiper frame 64 is oriented so that the first and second blades 60 and 62, respectively, are oriented generally tangential to the top surface of the strip S of sheet material so that the edge portion of each blade is maintained in firm engagement with the surface of the strip S throughout the space defined between the bails 50. When the strip S is fed between the roller platen 24 and print head 26, the wiper blades 60 and 62 continuously wipe the top surface of the strip S to remove any dust particles or other debris before the strip is passed beneath the print head.

As shown in FIG. 5, the first blade 60 is wider than the second blade 62, and thus the wiping edge of the first blade 60 extends beyond the wiping edge of the second blade 62 on the top surface of the strip S. Accordingly, if any particles pass beneath the first blade 60 they can be picked up by the second blade 62. Preferably, the first blade 60 is also slightly thicker than the second blade 62 such that each blade is designed to pick up dust particles or debris of different sizes. In the embodiment of the present invention illustrated, the first blade 60 is approximately 0.007 inch thick, and the second blade 62 is approximately 0.004 inch thick. The first blade 60 generally picks up most dust particles or other debris, and the second blade 62 picks up any smaller particles (typically less than 0.007 inch in diameter) that may pass beneath the first blade 60.

The first and second blades 60 and 62 are preferably made of rigid, yet flexible plastic material so that the edge portion of each blade can bend to conform to the contour of the strip S, yet be rigid enough so that the wiping edges are maintained in firm engagement with the top surface of the strip. The plastic material of the blades is preferably either conductive or static dissipative. Conductive materials are defined as having a surface resistivity of less than approximately $10^5$ ohms/square, and static dissipative materials are defined as having a surface resistivity within the range of approximately $10^5$ to $10^{12}$ ohms/square. The conductive or static dissipative blade 60,62 conduct or bleed static charge on the surface of the strip S into the respective wiper-blade assemblies 58 and to ground through the bails 50, and thus facilitate in eliminating or diminishing the existence of any static charge on the surface of the strip S, and in turn diminish the quantity of dust particles that collect on the strip S due to static electricity.

Another advantage of forming the blades 60,62 from a conductive or static dissipative plastic, as opposed to a typical insulative plastic (i.e., plastic having a surface resistivity greater than approximately $10^{12}$ ohms/-square), is that with insulative blades, the continuous rubbing of the blades against the moving strip S could create a static charge on the surface of the strip, and tend to attract dust particles or other debris to the strip. The conductive or static dissipative blades 60,62, on the other hand, do not tend to create additional static charge, but rather provide a path to ground through the wiper assemblies 58 and bails 50 to bleed any static charge from the surface of the strip S.

As shown in FIG. 4, the thermal print head 26 is suspended from an upper support frame 76 that is pivotally mounted on an axle 78 on the back side of the housing 16. As shown in FIG. 2, the print head 26 is mounted on a suspension plate 80, which is coupled to the frame 76 by a series of bolts 82. The bolts 82 are secured on one end to the suspension plate 80 and slideably received within the frame 76, so that the suspension plate together with the print head 26 move vertically relative to the support frame 76. A coil spring 84 surrounds each sliding bolt 82 or may be separated therefrom and is seated between the frame 76 and suspension plate 80 to apply a downward pressure on the suspension plate, and press the print head 26 against the strip S as it is passed over the roller platen 24 along a line of contact. The print head 26 has a plurality of heating elements distributed evenly along the head from one end of the roller platen 24 to the other, and the heating elements are densely packed along the line of contact.

A pair of dancer rolls 86 are supported from the suspension plate 80 and are each located on an opposite side of the print head 26 relative to the other, as shown in FIG. 2. Each dancer roll 86 extends across the width of the print head 26 and functions to guide a donor web or foil W and maintain the web taut as it is passed in contact with the strip S between the print head 26 and roller platen 24. The donor web W bears a heat-sensitive printing ink or printing dye in black, white, or other colors on the surface of the web facing the strip S of sheet material. When the heating elements of the print head 26 are selectively energized, the portion of the ink located immediately under each energized heating element is released from the web W and transferred to the strip S. The width of the web W is substantially equal to that of the print head 26, and the web is moved synchronously with the strip S between the head and the roller platen 24 by virtue of the pressure applied by the coil springs 84 between the print head and roller platen.

Each dancer roll 86 is mounted approximately at its midpoint to the suspension frame 80 and is permitted to tilt on either side with respect to its central mount. The ends of each dancer roll are located within elongated slots 88 formed within tabs 90 extending downward from the suspension plate 80 to limit the extent of movement of each dancer roll when tilted about its center mount. When the dancer rolls 86 are pressed against the web W under the force of the springs 84, they are permitted to tilt about their center mounts to render the web taut without damaging the web, and thus prevent the web from skewing or wrinkling during operation.

As shown in FIG. 2, additional web-cleaning members or wiper blades 92 are mounted adjacent each dancer roll 86 and oriented so that the free edge of each blade 92 is substantially tangent to the respective dancer roll and contacting the side of the web W facing the print head 26 (opposite the ink). Each wiper blade 92 is generally V-shaped, wherein one leg of the V is mounted beneath a support bar 94 to the suspension frame 80, and the free edge portion of the other leg of the V is suspended in contact with the web W to pick up any dust particles or other debris located on the web before the web is passed with the strip S between the print head 26 and roller platen 24. Dust particles or other minute debris located between the print head 26 and the web W can affect the transfer of heat from the print head to the web, and thus degrade the print quality. The wiper blades 92 substantially remove any such particles from the web W prior to passage beneath the print head, and thus facilitate in maintaining optimal thermal-transfer properties between the print head and the web, and in turn prevent the degradation in print quality normally associated with the collection of dust or other such minute debris on the web W.

The wiper blades 92 are preferably made of the same plastic material as are the wiper blades 60,62 to facilitate eliminating arty static charge that may develop on the web W by bleeding any such charge through the blades and into the frame 76 to ground. A pair of static suppression brushes 96 may also be mounted on either side of the print head 26 to brush the side of the web W opposite from the printing ink and further facilitate the elimination of static electricity.

In the operation of the apparatus of the present invention, actuation of the step motor 31 rotatably drives the sprockets 28 and the roller platen 24, which in turn drives the strip S and web W between the print head 26 and roller platen. During a printing operation, the strip S and web W move in the direction of the arrows shown in FIG. 3, and the wiper assembly 58 continuously wipes the top surface of the strip S on the supply side of the print head to remove any dust particles or other debris prior to printing. Because the blades 60,62 are rigid and are suspended in contact with the top surface of the strip S across the width of the print head, the blades also facilitate in maintaining the strip in firm contact with the cylindrical surfaces of the sprockets 28 and the roller platen 24 to prevent any wrinkling, buckling or distortion of the strip. The blade 92 on the supply side of the print head 26 likewise continuously wipes the top surface of the web W to remove any dust particles or other minute debris from the web prior to printing. As described above, dust particles or other minute debris located between the web W and the print head 26 can affect the transfer of heat from the print head to the web and degrade the print quality.

The blades 60,62 and 92 located on the discharge side of the print head 26 continuously wipe the strip S and web W clean of any dust particles and other minute debris when the strip S is driven back in the opposite direction of the arrows in FIG. 3. This normally occurs between printing operations. For example, in creating a multi-color display, the strip S is first driven between the print head 26 and roller platen 24 in the direction of the arrows in FIG. 3 with a first color. When printing with the first color is completed, the strip S is driven back in the opposite direction and wound again onto the roller 14, another web W of a second color is installed, and the strip S and web W are again driven relative to the print head in the direction of the arrows in FIG. 3 to print the second color. This procedure is continued until all colors of the multi-color display are printed. Thus, when the sheet S and web W are moved in either direction, the blades 60,62 and 92 continuously wipe the strip and web prior to passage between the print head and platen.

By continuously wiping the strip S and the web W prior to printing, the apparatus of the present invention can remove substantially all dust particles and other minute debris of any significance, and thus significantly enhance the print quality of the printer 10 by avoiding the fuzziness, blurring or other aberrations normally associated with the collection of dust particles or other minute debris on the strip S or web W. The blades 60,62 and 92 on the discharge side of the print head 26 also facilitate in maintaining the strip S, web W, and print head 26 clean and free of dust particles and other minute debris that may degrade the print quality of the printer 10. The conductive or static dissipative properties of the blades 60,62 and 92 also facilitate in eliminating static electricity, and in turn reduce the collection of dust particles or other minute debris on the strip S and web W, further enhancing the print quality of the printer 10.

Figure 7:
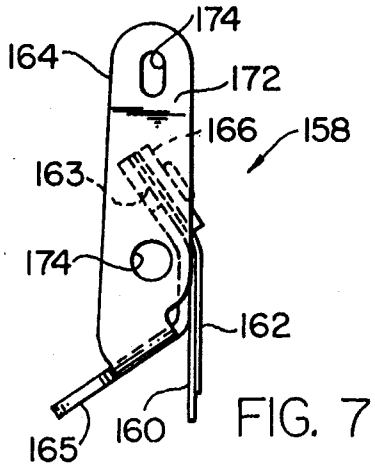
FIG. 7 is an end plan view of another embodiment of a web-cleaning assembly of the present invention for removing dust particles and other debris from the surface of the sheet material.
Figure 8:
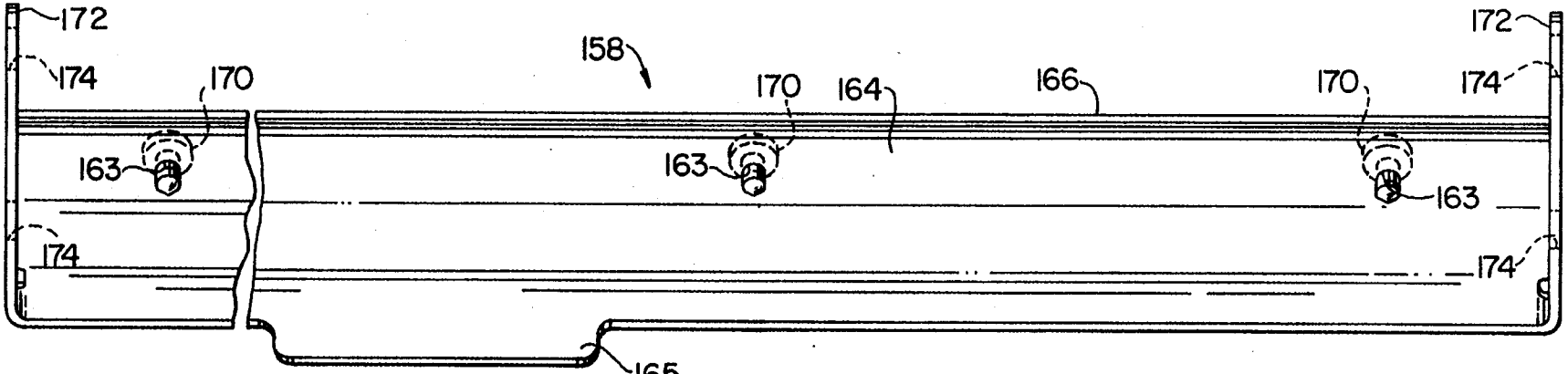
FIG. 8 is a front plan view of the web-cleaning assembly of FIG. 7.

In FIGS. 7 and 8, another embodiment of a wiper blade assembly of the present invention is indicated generally by the reference numeral 158. The wiper assembly 158 is similar to the wiper assembly 58 described above, and therefore like reference numerals preceded by the numeral 1 are used to indicate like elements. Each wiper assembly 158 differs from the wiper assemblies 58 in that the frame 164 includes a flared portion 165 spaced above the strip S and oriented generally parallel to the strip to cover and protect the blades 60, 62.

Figure 9:
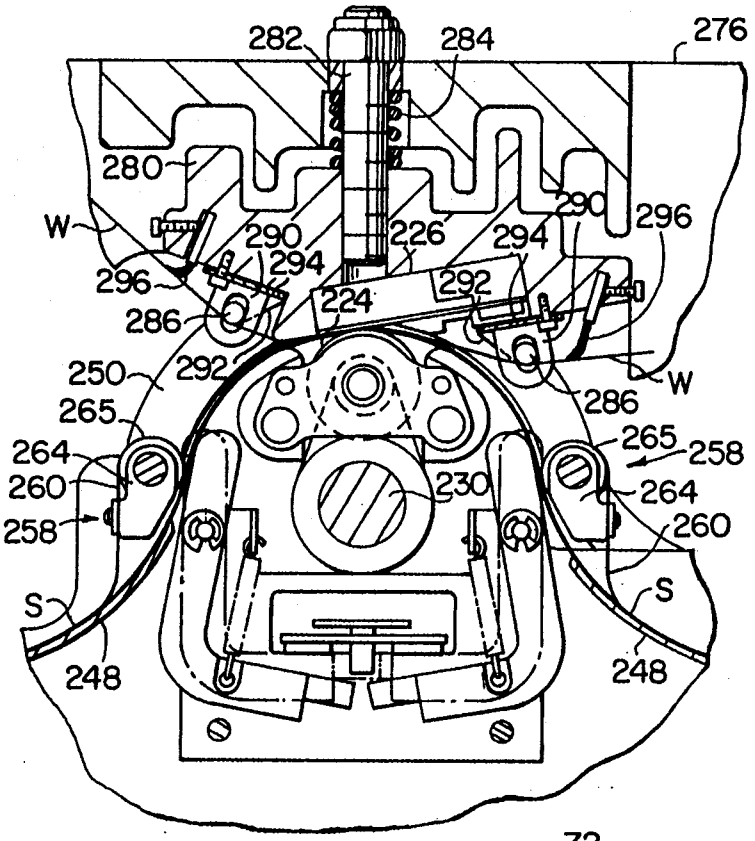
FIG. 9 is an enlarged fragmentary view of the printer of FIG. 1 illustrating another embodiment of a web-cleaning assembly of the present invention for removing dust particles and other debris from the surface of the sheet material.

In FIG. 9, another embodiment of a wiper-blade assembly of the present invention is illustrated and indicated generally by the reference numeral 258. Each wiper assembly 258 is similar in certain respects to the wiper assemblies 58 described above, and therefore like reference numerals preceded by the numeral 2 are used to indicate like elements. In this embodiment of the present invention, the printer 10 includes a pair of holddown rollers 265, each extending between the bails 50 at the supply and discharge locations of the roller platen 24. The cylindrical surface of each holddown roller 265 is seated in contact with the strip S to prevent wrinkling, buckling, or distortion of the strip. Each wiper-blade assembly 258 includes a wiper-blade 260 fixedly mounted on one side to a frame 264 coupled to and extending between the bails 250. As shown in FIG. 9, one side of each blade 260 is oriented in a plane substantially tangential to the cylindrical surface of the adjacent holddown roller 265, and the respective edge portion of that side is suspended in contact with the cylindrical surface of the roller. The other side of each blade 260 is oriented downward toward the strip S, and the edge portion of that side is seated in contact with the top surface of the strip S, as shown in FIG. 9. The blades 260 are preferably made of the same conductive or static dissipative plastic as are the other blades described above, and function to remove any dust particles or other minute debris on the top surface of the strip S and collected on the holddown rollers 265, and to eliminate or minimize the development of static charges.

While the present invention has been described through several preferred embodiments, it should be understood that numerous modifications and substitutions can be had without departing from the spirit of the present invention and scope of the appended claims. For example, it is clear that the wipers of the present invention may be employed in any of numerous types of printing apparatus, and not only the type of printer disclosed herein. The number of wiper blades, the locations of the blades, and the shapes of the blades may also be varied to form numerous different configurations that provide means for continuously wiping a strip of sheet material and/or a donor web during printing operations to remove dust particles or minute debris, and enhance the print quality of the apparatus in accordance with the present invention. It may also be desirable to simply replace the dancer rolls with the wiper blades, and thus the blades in this situation would function not only to remove dust particles and debris from the web or foil, but also to guide the web and render the web taut to prevent the web from skewing or wrinkling during operation.

I claim:

1. An apparatus for printing images on sheet material, comprising:

a housing;

a platen mounted within the housing for supporting the sheet material;

a print head mounted adjacent to the platen for receiving the sheet material between the platen and the print head and printing images onto the sheet material passed between platen and the print head; and at least one first wiper blade mounted within housing and defining at least one edge portion contacting the surface of the sheet material facing the print head and extending across the sheet material a distance approximately equal to at least the distance within which the print head prints images on the sheet material, the at least one edge portion being oriented generally tangential to the contacted surface of the sheet material and projecting in a direction substantially opposite a respective direction of movement of the sheet material, the at least one edge portion continuously wiping the sheet material upon movement of the sheet material in the respective direction and picking up dust particles and other debris from the sheet material on the edge portion to substantially prevent the passage of such particles beneath the edge portion to enhance the print quality of the apparatus; and at least one second wiper blade mounted between the at least one first wiper blade and the sheet material and defining at least one edge portion oriented relative to the sheet material for contacting the sheet material and extending across the sheet material a distance approximately equal to at least the distance within which the print head prints images on the sheet material, for continuously wiping the sheet material during printing operations to remove dust particles and other minute debris from the sheet material not removed by the at least one first wiper blade.

2. An apparatus as defined in claim 1, comprising two first wiper blades mounted on opposite sides of the platen relative to each other and two second wiper blades, each second wiper blade being mounted adjacent a respective first wiper blade.

3. An apparatus as defined in claim 1, wherein the edge portion of the at least one first wiper blade is made of a static dissipative material.

4. An apparatus for printing images on sheet material, comprising:

a housing;

a platen mounted within the housing for supporting the sheet material;

a print head mounted adjacent to the platen for receiving the sheet material between the platen and the print head and printing images onto the sheet material passed between the platen and the print head;

at least one first wiper blade mounted within the housing and defining at least one edge portion oriented relative to the sheet material to contact the surface of the sheet material facing the print head and extending across the sheet material distance approximately equal to at least the distance within which the print head prints images on the sheet material, for continuously wiping the sheet material during printing operations to remove dust particles and other debris from the sheet material and enhance the print quality of the apparatus; and a web bearing ink interposed between the print head and the platen to form images on the sheet material by transfer of ink from the web to the sheet material, and at least one second wiper blade mounted within the housing and defining at least one edge portion suspended in contact with the web and extending across the web a distance equal to at least approximately the width of the web for continuously wiping the web to remove dust particles and other minute debris and enhance the print quality of the apparatus.

5. An apparatus as defined in claim 4, comprising two second wiper blades mounted on opposite sides; of the print head relative to each other.

6. An apparatus as defined in claim 4, wherein the edge portion of the at least one first wiper blade is made of a substantially conductive plastic material.

7. An apparatus as defined in claim 4, further comprising the sheet material received between the platen and the print head for receiving printed images, the surface of the sheet material facing the print head being made of a plastic material.

8. An apparatus as defined in claim 7, wherein the plastic material is a vinyl.

9. An apparatus for printing graphic images on sheet material, comprising:

a print head mounted within the apparatus for printing graphic images on the sheet material;

a support member mounted adjacent to and facing the print head for supporting the sheet material adjacent the print head;

means for feeding the sheet material relative to the print head between the support member and the print head; and means for wiping at least the portion of a surface of the sheet material facing the print head upon which graphic images are printed by the print head including at least one first blade member mounted within the housing and including a first surface facing the sheet material and defining an edge portion contacting the sheet material, and a second surface substantially opposite the first surface, the edge,portion being oriented generally tangential to the contacted surface of the sheet material and projecting in a direction substantially opposite a respective direction of movement of the sheet material, the edge portion and second surface picking up dust particles or other debris upon movement of the sheet material in the respective direction and substantially preventing their passage beneath the edge portion to enhance the print quality of the apparatus, and wherein the means for wiping the sheet material further includes at least one second blade member mounted between the at least one first blade member and the sheet material and defining an edge portion oriented relative to the sheet material to contact the sheet material and extending across the sheet material a distance approximately equal to at least the distance within which the print head prints images on the sheet material to remove dust particles or debris from the surface of the sheet material not removed by the adjacent first blade member.

10. An apparatus as defined in claim 9, comprising two first blade members mounted on opposite sides of the support member relative to each other, one first blade member being oriented relative to the sheet material to wipe the sheet material upon passage of the sheet material between the support member and the print head in a first direction, and the other first blade member being oriented relative to the sheet material to wipe the sheet material upon passage of the sheet material between the support member and the print head in a second direction opposite the first direction.

11. An apparatus as defined in claim 9, wherein the edge portion of the at least one first blade member is thicker than the edge portion of the at least one second blade member.

12. An apparatus as defined in claim 9, wherein the edge portion of the at least one first blade member is made of a static dissipative material.

13. An apparatus for printing graphic images on sheet material, comprising a print head mounted within the apparatus for printing graphic images on the sheet material;

a support member mounted adjacent to and facing the print head for supporting the sheet material adjacent the print head;

means for feeding the sheet material relative to the print head between the support member and the print head;

means for wiping at least the portion of a surface of the sheet material facing the print head upon which graphic images are printed by the print head to remove dust particles or other debris and enhance the print quality of the apparatus;

a web bearing ink;

means for feeding the web between the print head and the sheet material for transferring ink from the web to the sheet material to form graphic images on the sheet material; and means for wiping a surface of the web facing the print head along a line extending across the width of the web for removing dust particles and other débris on the surface of the web to enhance the print quality of the apparatus.

14. An apparatus as defined in claim 13, wherein the means for wiping the web includes at least one blade member mounted within the apparatus and defining at least one edge portion contacting the surface of the web facing the print head.

15. An apparatus as defined in claim 14, comprising two blade members mounted on opposite sides of the print head relative to each other.

16. An apparatus as defined in claim 14, wherein the edge portion of the at least one blade member is formed from a static dissipative material.

17. An apparatus for forming graphic images on sheet material, comprising:

first means for forming graphic images on the sheet material, including a print head and support mounted adjacent to and facing the print head for supporting the sheet material adjacent to the print head;

second means for feeding the sheet material between the support and print head;

third means for continuously removing dust particles and other debris from a surface of the sheet material facing the first means upon movement of the sheet material relative to the first means, extending across a portion of the surface of the sheet material approximately equal to at least the portion of the surface upon which the first means forms graphic images, and including a first surface facing the sheet material and defining an edge portion contacting the sheet material, and a second surface substantially opposite the first surface, the edge portion being oriented generally tangential to the contacted surface of the sheet material and projecting in a direction substantially opposite a respective direction of movement of the sheet material, the edge portion picking up the dust particles and other debris upon movement of the sheet material in the respective direction and substantially preventing their passage beneath the edge portion to enhance the print quality of the apparatus;

a web bearing ink;

means for feeding the web between the print head and the sheet material for transferring ink from the web to the sheet material to form graphic images on the sheet material; and means for wiping a surface of the web facing the print head along a line extending across the width of the web for removing dust particles and other debris on the surface of the web to enhance the print quality of the apparatus.

18. An apparatus as defined in claim 17, further comprising at least one roller rotatably mounted within the apparatus, the roller defining a substantially cylindrical surface contacting the surface of the sheet material facing the first means and rotatable upon movement of the sheet material relative to the first means, wherein the third means includes at least one blade member mounted within the apparatus and defining at least one edge portion extending substantially in the axial direction of the roller and contacting the cylindrical surface of the roller to remove dust particles and other debris from the cylindrical surface of the roller.

19. An apparatus as defined in claim 17, wherein the third means includes at least one blade member mounted within the housing and defining at least one edge portion oriented relative to the sheet material for contacting the surface of the sheet material facing the first means upon movement of the sheet material relative to the first means.

* * * * *

UNITED STATES PATENT AND TRADEMARK OFFICE

CERTIFICATE OF CORRECTION

PATENT NO. : 5,421,261

DATED : June 6, 1995

INVENTOR(S) : Joseph W. Stempien

It is certified that error appears in the above-identified patent and that said Letters Patent is hereby corrected as shown below:

Claim 9:

Column 11, Line 61, delete "edge,portion" and insert --edge portion--.

Signed and Sealed this

Fifth Day of September, 1995

*Attest:*

Bruce Lehman

BRUCE LEHMAN

*Attesting Officer*

*Commissioner of Patents and Trademarks*